US010508816B2

(12) United States Patent
Tian et al.

(10) Patent No.: US 10,508,816 B2
(45) Date of Patent: Dec. 17, 2019

(54) INTERLOCK SWITCH STRUCTURE AND MICROWAVE OVEN

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Yun Tian, Foshan (CN); Baikang Wu, Foshan (CN); Yuliang Dang, Foshan (CN)

(73) Assignees: GUANGDONG MIDEA KITCHEN APPLIANCES MANUFACTURING CO. LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/910,916

(22) Filed: Mar. 2, 2018

(65) Prior Publication Data

US 2018/0187901 A1 Jul. 5, 2018

Related U.S. Application Data

(63) Continuation of application No. PCT/CN2016/110484, filed on Dec. 16, 2016.

(30) Foreign Application Priority Data

Jun. 12, 2016 (CN) ..... 2016 1 0427113
Jun. 12, 2016 (CN) ..... 2016 2 0566625 U

(51) Int. Cl.
*H01H 9/22* (2006.01)
*F24C 15/02* (2006.01)
(Continued)

(52) U.S. Cl.
CPC ..... *F24C 15/022* (2013.01); *F24C 7/02* (2013.01); *F24C 15/021* (2013.01); *H05B 6/76* (2013.01); *H05B 2206/04* (2013.01)

(58) Field of Classification Search
CPC ..... H01H 21/06; H01H 9/226; H01H 9/223; H01H 9/26; H01H 9/24; H01H 3/161;
(Continued)

(56) References Cited

U.S. PATENT DOCUMENTS 4,048,822 A * 9/1977 Luling ..... E05C 17/04 292/262
4,527,873 A * 7/1985 Alligood ..... G03B 17/02 396/336
(Continued)

FOREIGN PATENT DOCUMENTS

CN 201983312 U 9/2011
CN 204100322 U 1/2015
(Continued)

OTHER PUBLICATIONS

Guangdong Midea Kitchen Appliances Manufacturing Co. Ltd., International Search Report and Written Opinion, PCT/CN2016/110484, dated Mar. 21, 2017, 16 pgs.
(Continued)

*Primary Examiner* — Ahmed M Saeed
(74) *Attorney, Agent, or Firm* — Morgan, Lewis & Bockius LLP

(57) ABSTRACT

An interlock switch structure and a microwave oven are disclosed. The interlock switch structure includes a substrate, a sliding latch, a tactile disk member, a door hook, a first elastic member, and multiple micro-switches. The substrate is provided with a chute structure, the sliding latch slidably matches with a chute of the chute structure, the sliding latch is provided with a sliding surface to match with the door hook. The tactile disk member is pivotally communicated with the substrate, the micro-switch is located on a periphery of the tactile disk member, and contact points of the micro-switches are toward the tactile disk member. The tactile disk member is provided with a seesaw to match with
(Continued)

the door hook; a circumferential surface of the tactile disk member is provided with a rotating surface to match with the sliding latch.

16 Claims, 10 Drawing Sheets

(51) Int. Cl.
*F24C 7/02* (2006.01)
*H05B 6/76* (2006.01)

(58) Field of Classification Search
CPC .. H01H 9/22; H01H 2027/005; H01H 27/002; H01H 9/104; H01H 27/007; H01H 3/163; H01H 9/286; H01H 11/0006; H01H 13/063; H01H 19/54; H01H 2013/066; H01H 2071/565; H01H 27/06; H01H 3/001; H01H 3/20; H01H 50/32; H01H 71/56; H01H 9/28; H01H 9/281; H01H 9/285; F24C 7/02; F24C 15/022; F24C 15/023
See application file for complete search history.

(56) References Cited

U.S. PATENT DOCUMENTS 5,895,601 A 4/1999 Kim
2003/0005732 A1* 1/2003 Moriyama ..... H01H 27/002 70/31
2008/0257700 A1* 10/2008 Bacigalupe ..... H01H 9/226 200/329
2013/0069512 A1* 3/2013 Zimmer ..... H05B 1/00 312/326
2015/0068509 A1* 3/2015 Gayle ..... F24C 15/022 126/197
2016/0251877 A1* 9/2016 Reddmann ..... E05B 77/28 292/200
2017/0293322 A1* 10/2017 Hou ..... G11B 33/02

FOREIGN PATENT DOCUMENTS

CN 105889995 A 8/2016
CN 205690457 U 11/2016
CN 205690458 U 11/2016
CN 205693924 U 11/2016
CN 205825147 U 12/2016
CN 205825151 U 12/2016

OTHER PUBLICATIONS

Guangdong Midea Kitchen Appliances Manufacturing Co. Ltd., International Preliminary Report on Patentability, PCT/CN2016/110484, dated Dec. 18, 2018, 5 pgs.

* cited by examiner

INTERLOCK SWITCH STRUCTURE AND MICROWAVE OVEN

PRIORITY CLAIM AND RELATED APPLICATION

This application is a continuation application of PCT/CN2016/110484, entitled "INTERLOCK SWITCH STRUCTURE AND MICROWAVE OVEN" filed on Dec. 16, 2016, which claims priority to: (i) Chinese Patent Application No. 201610427113.9, filed with the State Intellectual Property Office of the People's Republic of China on Jun. 12, 2016, and (ii) Chinese Patent Application No. 201620566625.9, filed with the State Intellectual Property Office of the People's Republic of China on Jun. 12, 2016, all of which are incorporated herein by reference in their entirety.

TECHNICAL FIELD

The present disclosure relates to a field of microwave oven, and in particular to an interlock switch structure and a microwave oven.

BACKGROUND

A door hook of an interlock switch of a microwave oven is fixedly communicated with a door of the microwave oven, a lock is provided inside the door of the microwave oven. In order to prevent microwave leakage, when the door of the microwave oven is opened or closed, the micro-switches in the interlock switch needs to trigger or reset in the preset order under an action of the door hook.

The prior interlock control switches have a door hook which is touched and matched with a plurality of cams and each cam is matched with the corresponding micro-switches. That is, the door hook achieves the safety control of the microwave oven in a multi-touch way and subjects to the assembly precision between the various components, so that the reliability of the entire control is poor.

SUMMARY

The main purpose of the present disclosure is to provide an interlock switch structure, which is intended to solve technical problems that prior interlock switches cannot reliably switch micro-switches and also cannot complete a control.

In order to achieve the above purpose, the interlock switch structure provided in the present disclosure includes a substrate, a sliding latch, a tactile disk member, a door hook, a first elastic member, and multiple micro-switches;

the substrate is provided with a chute structure, the sliding latch is slidably matched with a chute of the chute structure, the sliding latch is provided with a sliding surface to match with the door hook;

the tactile disk member is pivotally communicated with the substrate, the micro-switches are located on a periphery of the tactile disk member, and contact points of the micro-switches are toward the tactile disk member;

the tactile disk member is provided with a seesaw to match with the door hook; a circumferential surface of the tactile disk member is provided with a rotating surface to match with the sliding latch, and a plurality of contact surfaces that are matched with the contact points.

In a process of locking the door hook, the door hook sequentially abuts the sliding latch and the seesaw; the sliding latch is displaced, and the tactile disk member is rotated in a forward direction; and each contact surface abuts a corresponding contact point, triggering a corresponding micro-switch.

In a process of releasing the door hook, the sliding latch is reset by the first elastic member and it abuts the sliding surface; and the tactile disk member is rotated in reverse; and each contact surface leaves the corresponding contact point, resetting the corresponding micro-switch.

In some embodiments, the tactile disk member includes a plate shaped disk body and a flange that is vertically disposed at an edge of the disk body. The rotating surface and the contact surfaces are formed on the flange. A rotating axis of the tactile disk member is perpendicular to the substrate, and the disk body is in parallel to the substrate.

In some embodiments, the circumferential surface of the tactile disk member is provided with inclined surfaces to communicate with the contact surfaces. When the tactile disk member is rotated in a forward direction, the contact points abut the inclined surfaces at first and then abut the contact surfaces.

In some embodiments, the substrate is provided with a via hole at a position corresponding to the seesaw; the seesaw is passed through the via hole and rotated with the substrate in the via hole.

In some embodiments, a supporting board is convexly provided on a side of the tactile disk member that is deviated from the substrate; the supporting board is disposed at an edge of the via hole.

In some embodiments, a rotating shaft is convexly arranged on the substrate, a shaft hole is arranged on the disk body to match with the rotating shaft, the disk body is provided with a shaft sleeve that is located on an edge of the shaft hole, and the shaft sleeve is matched with the rotating shaft.

In some embodiments, a panel is vertically arranged on an edge of the substrate, the panel is provided with a socket to match with the door hook.

The chute structure is integrally provided with the panel, and the chute structure is provided with an opening on the panel for loading the sliding latch.

In some embodiments, the micro-switches include a primary switch, a secondary switch and a supervisory switch. In the process of locking the door hook, the tactile disk member sequentially abuts the contact points of the supervisory switch, the secondary switch and the primary switch; in the process of releasing the door hook, the tactile disk member sequentially leaves the contact points of the primary switch, the secondary switch and the supervisory switch.

In some embodiments, the interlock switch structure further includes a pressure plate and a second elastic member, the pressure plate provided on a side of the substrate that is deviated from the tactile disk member, and the second elastic member is provided between the pressure plate and the substrate. The pressure plate is pivotally communicated with the substrate, and the pressure plate is provided with a hook to match with the door hook.

The present disclosure also provides a microwave oven, including an interlock switch structure, an interlock switch structure includes a substrate, a sliding latch, a tactile disk member, a door hook, a first elastic member, and a plurality of micro switches;

The substrate is provided with a chute structure, the sliding latch is slidably matched with the chute of the chute structure, the sliding latch is provided with the sliding surface to match with the door hook.

The tactile disk member is pivotally communicated with the substrate, the micro-switches are located on a periphery of the tactile disk member, and contact points of the micro-switches are toward the tactile disk member.

The tactile disk member is provided with a seesaw to match with the door hook; a circumferential surface of the tactile disk member is provided with a rotating surface to match with the sliding latch, and a plurality of the contact surfaces that are matched with contact points.

In the process of locking the door hook, the door hook sequentially abuts the sliding latch and the seesaw; the sliding latch is displaced, and the tactile disk member is rotated in a forward direction; each of the contact surface abuts the corresponding contact points, triggering the micro-switch.

In the process of releasing the door hook, the sliding latch is reset by the first elastic member and it abuts the sliding surface; and the tactile disk member is rotated in reverse; each of the contact surface leaves the corresponding contact points, resetting a corresponding one of the micro-switches.

In some embodiments, the door hook is provided on the door of the microwave oven, and the substrate is provided on a furnace of the microwave oven.

In some embodiments, the microwave oven as a whole is in a cylindrical shape.

The interlock switch structure of the present disclosure, by means of the plurality of the contact surfaces provided on the circumferential surface of the tactile disk member, is configured to communicate with the contact points of the micro-switches. The door hook only needs to touch the tactile disk member to achieve the switching between the micro-switches, thus improving stability of the control.

BRIEF DESCRIPTION OF THE DRAWINGS

To illustrate the technical solutions according to the embodiments of the present disclosure more clearly, the accompanying drawings for describing the embodiments are introduced briefly in the following. Apparently, the accompanying drawings in the following description are only about some embodiments of the present disclosure, and persons of ordinary skill in the art can derive other drawings from the accompanying drawings without creative efforts.

DESCRIPTION OF THE REFERENCE NUMERAL

Figure 1:
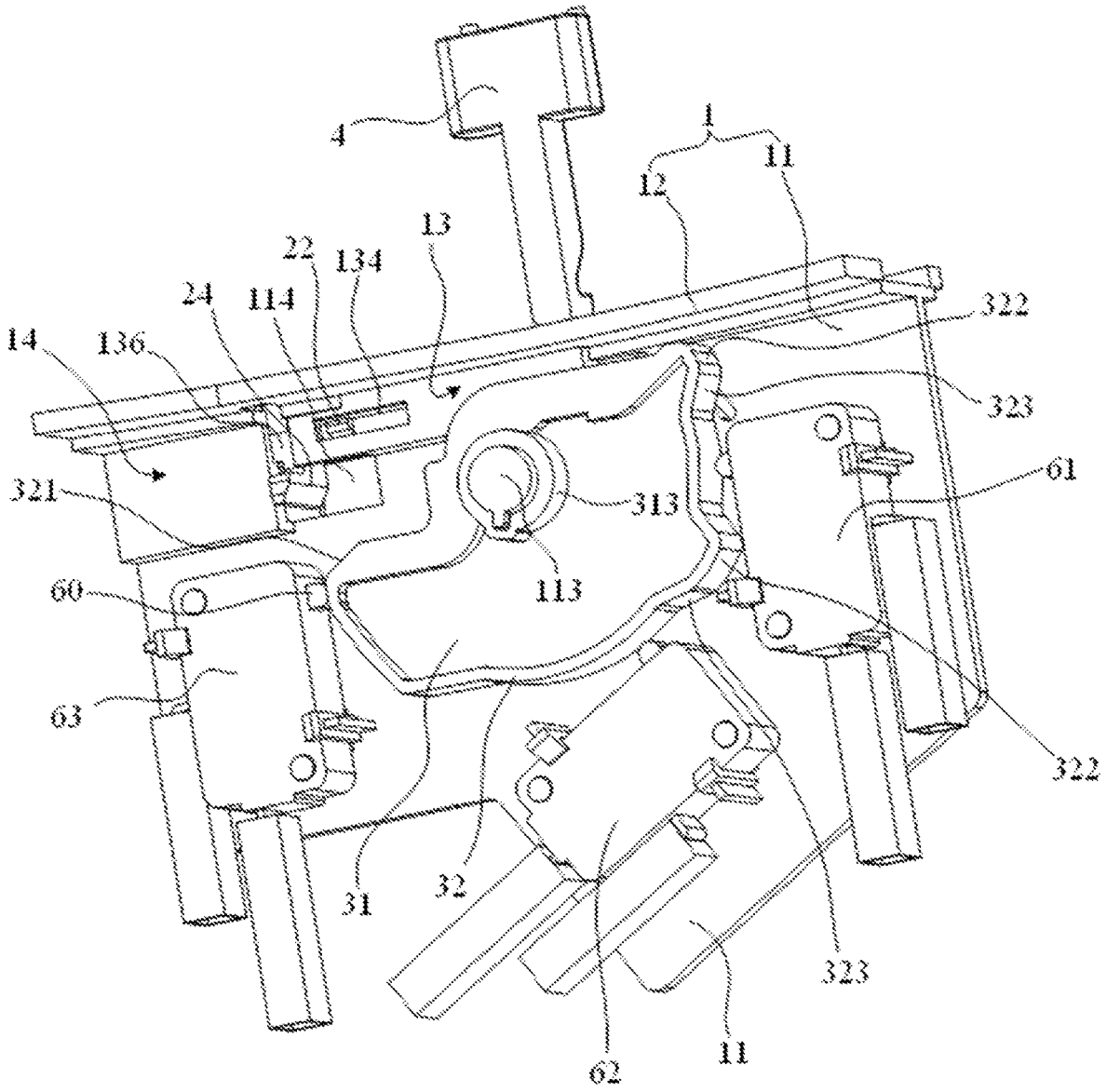
FIG. 1 illustrates an interlock switch structure according to an embodiment of the present disclosure.
Figure 2:
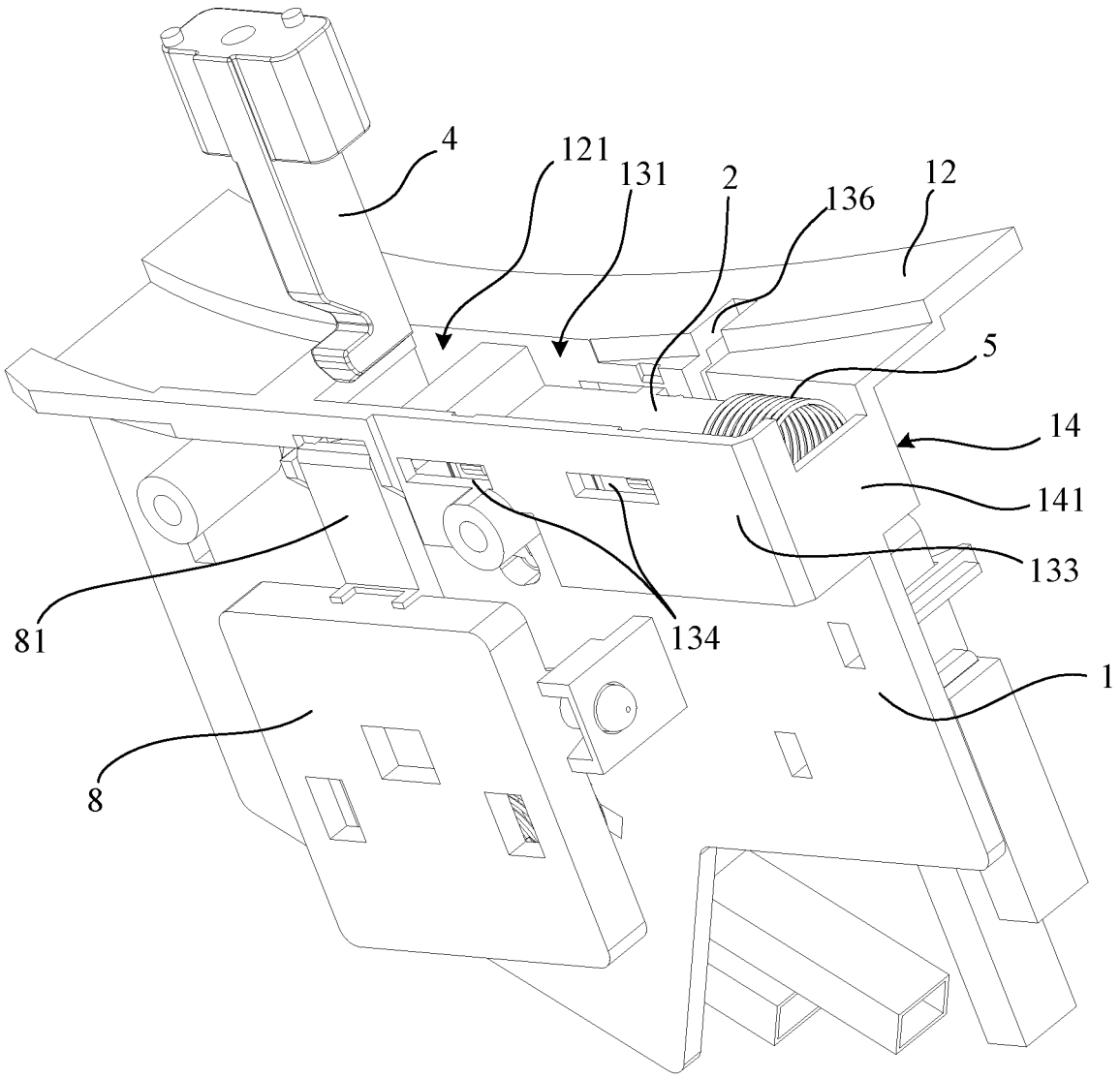
FIG. 2 illustrates an interlock switch structure in FIG. 1 from another angle.
Figure 3:
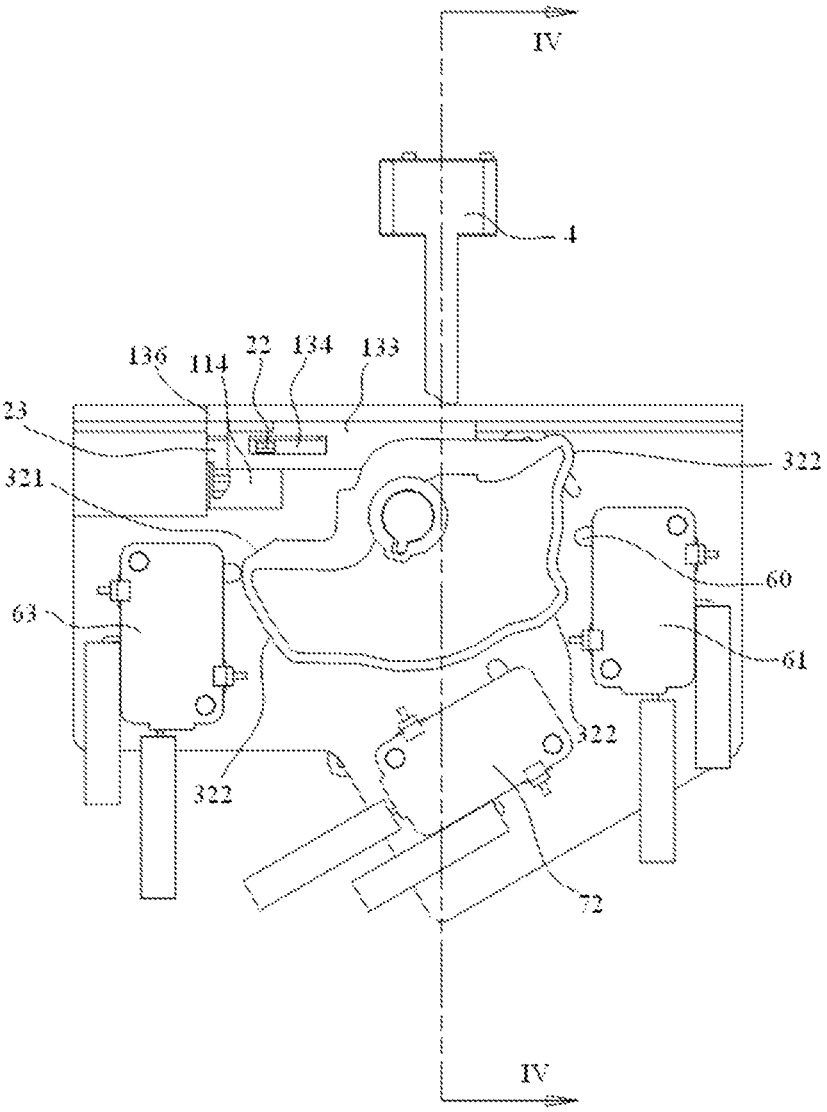
FIG. 3 is a front view of an interlock switch structure in FIG. 1.

| Reference numeral | Name | Reference numeral | Name | Reference numeral | Name |
|---|---|---|---|---|---|
| 1 | Mounting base | 136 | Opening slot | 313 | Shaft sleeve |
| 11 | Substrate | 14 | Card slot structure | 32 | Flange |
| 111 | Via hole | 141 | Card boards | 321 | Rotating surface |
| 112 | Supporting board | 142 | Bottom board | 322 | Contact surfaces |
| 113 | Rotating shaft | 2 | Sliding latch | 323 | Inclined surfaces |
| 114 | Evading hole | 21 | Sliding surface | 4 | Door hook |
| 12 | Panel | 22 | Sliding bulges | 5 | First elastic |
| 121 | Socket | 23 | Baffle plate | | member |
| 13 | Chute structure | 24 | Push rod | 60 | Contact points |
| 131 | Opening | 25 | Tail board | 61 | Primary switch |
| 132 | Bottom wall | 3 | Tactile disk | 62 | Secondary switch |
| 133 | Side walls | | member | 63 | Supervisory switch |
| 134 | Slot | 31 | Disk body | 8 | Pressure plate |
| 135 | Guide slot | 311 | Seesaw | 81 | Hook |
| | | 312 | Shaft hole | 9 | Second elastic member |

Objective achieving, function features, and advantages of the present disclosure are further described with reference to the embodiments and the accompany drawings.

DETAILED DESCRIPTION OF THE EMBODIMENTS

Technical solutions of the present disclosure are further described in detail with reference to the accompanying drawings and embodiments. It is to be understood that the specific embodiments described herein are merely used for describing the present disclosure, but are not intended to limit the present disclosure. Based on embodiments in the present disclosure, all other embodiments obtained by those of ordinary skill in the art without making creative work are within the scope of the present disclosure.

It should be noted that the directional terms (such as up, down, left, right, front and rear . . . ) in the embodiments of the present disclosure are merely used to explain the relative positions, the movement situation, etc. of each component within a particular gesture (as shown in the accompanying drawings), and if the particular posture changes, the directional terms also changes accordingly.

In addition, the description of "first", "second" and the like in the present disclosure is used for the purpose of description only, and cannot be construed as indicating or implying its relative importance or implicating the number of the indicated technical features. Thus, the feature that defines "first", "second" expresses or implicates that it includes at least one of the described features. In addition, the technical solution between various embodiments are combined with each other, but must be based on the realization of those ordinary skill in the art. When the combination of technical solution arises contradictory or cannot be achieved, the combination of such a technical solution should be considered as non-existent, and is not within the scope of the disclosure as claimed.

The present disclosure relates to an interlock switch structure.

In the embodiments of the present disclosure, as shown in FIG. 1, FIG. 2, FIG. 11, and FIG. 12, the interlock switch structure includes a substrate 11, a sliding latch 2, a tactile disk member 3, a door hook 4, a first elastic member 5, and the micro-switches.

The substrate 11 is provided with a chute structure 13, the sliding latch 2 is slidably matched with a chute of the chute structure 13, the sliding latch 2 is provided with a sliding surface 21 to match with the door hook 4.

The tactile disk member 3 is pivotally communicated with the substrate 11, the micro-switches are located on a periphery of the tactile disk member 3, and contact points 60 of the micro-switches are toward the tactile disk member 3.

The tactile disk member 3 is provided with a seesaw 311 to match with the door hook 4; a circumferential surface of the tactile disk member 3 is provided with a rotating surface 321 to match with the sliding latch 2 and a plurality of contact surfaces 322 that are matched with the contact points 60.

With reference to FIG. 7 to FIG. 10, in a process of locking the door hook, the door hook 4 sequentially abuts the sliding latch 2 and the seesaw 311. The sliding latch 2 is displaced, and the tactile disk member 3 is rotated in the forward direction; and each of the contact surface 322 abut each of the corresponding contact points 60, triggering each micro-switch;

With reference to FIG. 3 to FIG. 6, in a process of releasing the door hook, the sliding latch 2 is reset by a first elastic member 5 and it abuts a sliding surface 21; and the tactile disk member 3 rotates reversely; each of the contact surfaces 322 leave each of the corresponding contact points 60, triggering a corresponding one of the micro-switches.

In the present embodiments, the substrate 11 is a part of a mounting base 1 of the interlock switch structure. The substrate 11 is generally an injection molding member for providing mounting support for other parts of the interlock switch structure, thus ensuring a positional cooperation relationship among parts.

In general, the door hook 4 is fixedly communicated with a door of the microwave oven. When the door of the microwave oven is closed, an insertion direction of the door hook 4 is in parallel to a plane where the substrate 11 is located.

The sliding latch 2 is used for the tactile disk member 3 after a force of the door hook 4 is removed. In order to prevent scratching of the rotating surface 321 on the tactile disk member 3, the sliding latch 2 is provided with a matching surface for fitting with the rotating surface 321.

The seesaw 311 of the tactile disk member 3 is eccentrically disposed in relation to a rotation axis of the tactile disk member 3 and it is obliquely disposed in relation to the insertion direction of the door hook 4. The plurality of the contact surfaces 322 are disposed on the periphery of the tactile disk member 3 at intervals, used to trigger and leave the contact points 60 that are corresponding to the micro-switches in a preset order.

The number of the micro-switches can be two, three or four, depending on design needs. Main functions of the micro-switches usually include a total circuit control of the microwave oven, a control circuit for detecting the door opening or closing on the microwave oven and a control for controlling a switching circuit.

In the interlock switch structure of the present disclosure, the plurality of the contact surfaces 322 are provided on a circumferential surface of the tactile disk member 3, so as to communicate with the contact points 60 of the micro-switches. The door hook 4 achieves a switch between the micro-switches only by touching the tactile disk member 3, thus improving stability of the control.

In addition, since a lock and the door hook 4 of the present disclosure require few parts for realizing an interlock control, the structure is more compact, less restrictive in installation. In the embodiments, the lock and the door hook 4 are applied to a side door microwave oven and a top door microwave oven.

Furthermore, the tactile disk member 3 includes a plate shaped disk body 31 and a flange 32 that is vertically disposed at an edge of the disk body 31. The rotating surface 321 and the contact surfaces 322 are formed on the flange 32. The rotating axis of the tactile disk member 3 is perpendicular to the substrate 11, and the disk body 31 is in parallel to the substrate 11.

In the present embodiments, it should be understood that if the tactile disk member 3 is simply took advantage of a thin-walled structure, an area of the contact surfaces 322 that can be formed on the circumferential surface of the tactile disk member 3 is relatively small; when an axial mounting dimension of the tactile disk member 3 fluctuates greatly, it probably cannot guarantee a contact between the contact surfaces 322 and the corresponding contact points 60 of the micro-switches. A width of the contact surfaces 322 in the axial direction maybe increased by providing the flange 32, thus improving a matching stability between the contact surfaces 322 and the contact points 60.

Furthermore, the circumferential surface of the tactile disk member 3 has a plurality of inclined surfaces 323 to communicate with the contact surfaces 322. When the tactile disk member 3 is rotated in a forward direction, the contact points 60 abut the inclined surfaces 323 at first and then abut the contact surfaces 322.

In the present embodiments, it should be understood that although ends of the contact points 60 are generally provided with round corners, if the angle between a slot wall surface of an evading slot that is adjacent to the contact surfaces 322 and the corresponding contact surfaces 322 is too small, may cause the contact points 60 to jam. Therefore, by providing the inclined surfaces 323 on the circumferential surface of the tactile disk member 3 to communicate with the contact surfaces 322, ensuring that the contact points smoothly slide to match with the corresponding contact surfaces 322. The inclined surfaces 323 mainly plays a guiding role. Therefore, the inclined surfaces 323 may be any one of a planar shape, a concave arc surface or a convex arc surface.

Furthermore, the substrate 11 is provided with a via hole 111 at a position corresponding to the seesaw 311; the seesaw 311 is passing through the via hole 111 and rotating with the substrate 11 in the via hole 111.

In the present embodiments, the seesaw 311 is provided through the substrate 11, the force acts on the seesaw 311 from the door hook 4 is smaller than the distance between the substrate 11, and an overturning moment acts on the substrate 11 is smaller, so that the counter-force generated from the fixed substrate 11 is small.

Furthermore, a supporting board 112 is convexly provided on a side of the tactile disk member 3 that is deviated from the substrate 11. The supporting board 112 is disposed at an edge of the via hole 111.

In the present embodiments, it should be understood that, when the door hook 4 is inserted into a right place, due to an assembly error, in addition to generate a torque for rotating the tactile disk member 3, the torque for turning the seesaw 311 may also be generated. In this case, if the seesaw 311 is only supported by the edge of the via hole 111 and it is easy to break. By providing the supporting board 112 to support the seesaw 311 when the door hook 4 is inserted into the right place, it is possible to prevent the seesaw 311 from breaking.

Furthermore, a rotating shaft 113 is convexly arranged on the substrate 11, a shaft hole 312 is arranged on the disk body 31 to match with the rotating shaft 113; the disk body is provided with a shaft sleeve 313 that is located on an edge of the shaft hole 312 and matched with the rotating shaft 113.

In the present embodiments, the rotating shaft 113 is disposed on the substrate 11. During the installation, the rotating shaft 113 may be directly mounted on the tactile disk member 3. By providing the shaft sleeve 313 that is fitted with the rotating shaft 113, a length of the shaft hole 312 maybe correspondingly increased, so that the tactile disk member 3 rotates more smoothly.

Furthermore, with reference to FIG. 2, FIG. 4, FIG. 6, FIG. 8 and FIG. 10, in one embodiment, a panel 12 is vertically arranged on an edge of the substrate 11, the panel 12 is provided with a socket 121 to match with the door hook 4;

The chute structure 13 is integrally provided with the panel 12, and the chute structure 13 is provided with an opening 131 on the panel 12 for loading the sliding latch 2.

In the present embodiments, the mounting base 1 further includes the panel 12 that is vertically arranged on the edge of the substrate 11. Specifically, when the mounting base 1 is mounted on a cylindrical or an elliptical cylindrical microwave oven, the panel 12 is disposed adjacent to the door of the microwave oven, and an arch edge is provided to match with a microwave oven barrel;

By providing the panel 12, inside parts of the panel 12 are protected and outside parts are prevented from falling into the interlock switch structure. The chute is integrally provided with the panel 12, used to increase an intensity of the chute structure 13 and to facilitate an installation and a disassembly of the sliding latch 2 by providing the opening 131 of the chute on the panel 12.

In some embodiments, the panel 12 is provided with the socket 121 for penetrating the door hook 4, and the chute structure 13 is communicated with the socket 121. When in an initial position, the socket 121 is closed by the sliding latch 2, thus limiting the tactile disk member 3 to rotate in a forward direction before it reaches an ending position.

In general, the door hook 4 is fixedly communicated with the door of the microwave oven. When the door of the microwave oven is closed, the insertion direction of the door hook 4 is in parallel to the plane where the substrate 11 is located.

Furthermore, with reference to FIG. 2, FIG. 4, FIG. 6, FIG. 8, and FIG. 10, in one embodiment, the chute structure 13 includes a bottom wall 132 and two side walls 133 that are provided on the two opposite sides of the bottom wall 132, and the bottom wall 132 and the side walls 133 encompass the chute that matches with the sliding latch 2.

In the present embodiments, through the limiting of the bottom wall 132 and the side walls 133, whether the substrate 11 is installed vertically or horizontally, it will not impact the sliding of the sliding latch 2, preventing the sliding latch 2 from falling off the chute structure 13.

In some embodiments, the chute structure 13 is integrally provided with the panel 12, to increase the intensity of the chute structure 13; to facilitate the installation and the disassembly of the sliding latch 2 by providing the opening 131 on the panel 12.

Furthermore, on an end of the sliding latch 2 that is far away from the door hook 4 is provided with a baffle plate 23 extending to the direction of the rotating surface 321, and the baffle plate 23 is used to abut the rotating surface 321 and to reverse the tactile disk member 3; when the sliding latch 2 is reversely reset to the initial position, the baffle plate 23 is limited by the end of the bottom wall 132 that is far away from the door hook 4.

In the present embodiments, a movement of the sliding latch 2 can be effectively transferred to the tactile disk member 3 by providing the baffle plate 23 to abut the rotating surface 321. In some embodiments, the baffle plate 23 is perpendicular to a body of the sliding latch 2, and is integrally provided with the body of the sliding latch 2.

Furthermore, the bottom wall 132 is perpendicular to the substrate, a push rod 24 is provided on an end of the baffle plate 23 that is close to the tactile disk member 3; the baffle plate 23 is protruded from the push rod 24 on the direction of deviating from the substrate 11. An evading hole 114 is provided on a connected point between the substrate 11 and the bottom wall 132, used for activating the push rod 24. The opening slot 136 is provided on the side walls 133, used for loading the push rod 24 into the evading hole 114.

In the present embodiments, the push rod 24 is convexly provided on the baffle plate 23, which is conducive to enhance a work reliability of the sliding latch 2. For example, in a condition that a length of the push rod 24 is equal to a width of the rotating surface 321, when the push rod 24 and the rotating surface 321 are communicated in a line contact, the length of the contact line maybe increased; when the push rod 24 and the rotating surface 321 are communicated in a surface contact, an area of the surface contact maybe increased. In a condition of that the length of the push rod 24 is larger than the width of the rotating surface 321, the tactile disk member 3 on the rotating axis is loosened, and it may also ensure that the push rod 24 is in a good contact with the rotating surface 321.

Furthermore, sliding bulges 22 are provided on the two opposite sides between the sliding latch 2 and the side walls 133, and the side walls 133 is provided with a slot 134 to match with the sliding bulges 22.

In the present embodiments, it should be understood that when the sliding latch 2 is in the initial position, an end of the sliding latch 2 that is close to the socket 121, is actually in a suspended state. The force that is acted on the sliding surface 21 from the door hook 4, may make another end of the sliding latch 2 tilt along the direction of deviating from the bottom wall 132, especially when the door hook 4 abuts the sliding surface 21 with a relative high speed.

Therefore, by setting the sliding bulges 22 to match with the slot 134, to limit the sliding latch 2 on the direction of deviating from the bottom wall 132, so that the sliding latch 2 may bear an impact action of the door hook 4. In some embodiments, in order to prevent the sliding surface 21 from scratching the door hook 4, the door hook 4 is provided with a matching face to match with the sliding surface 21.

Furthermore, the edge of the side walls 133 that is far away from the tactile disk member 3, is provided with a guide slot 135 to communicate with the slot 134, and the guide slot 135 has a guiding inclined surface that is adjacent to the slot 134.

In the present embodiments, in a process of loading the sliding latch 2 into the chute structure 13 from the opening 131, in order to smoothly load the sliding bulges 22 into the guide slot 135, it needs to open a certain distance along the direction of deviating from each other of the two side walls 133, so it is difficult and may also lead to a break of the sliding bulges 22. By providing the guide slot 135, in an assembling process, the sliding bulges 22 are firstly clamped into the guide slot 135, and under the action of the guiding inclined surface, the two side walls 133 are gradually opened and smoothly slid into the slot 134. Since the guiding inclined surface is relatively close to the slot 134, the sliding bulges 22 may be quickly loaded into the slot 134 and save much labor.

Furthermore, the sliding surface 21 is the inclined surface that is toward the door hook 4, and an angle range at an insertion direction of the sliding surface 21 and the door hook 4 is 55 degrees to 65 degrees.

In the present embodiments, it should be understood that if the angle between the insertion direction of the sliding surface 21 and the door hook 4 is too large, and then a component force is smaller, and the component force is generated by an action of the door hook 4 on the sliding surface 21 and may lead the sliding latch 2 to slide; if the angle is too small, an entrance that is formed by the surrounding of the sliding surface 21 and a hole wall of the socket 121 that cannot effectively dock with the door hook 4. In some embodiments, when the sliding latch 2 is in the initial position, a gap less than 3 mm is formed between an end face of the sliding latch 2 and the hole wall of the socket 121 in a sliding direction of the sliding latch 2. In this way, the door hook 4 maybe more smoothly inserted into the socket 121 so as to push the sliding latch 2 to slide.

Furthermore, a card slot structure 14 is provided on one end of the substrate 11 that is close to the chute structure 13 and deviated from the door hook 4. An end of an elastic member 5 is clamped with the card slot structure 14, and another end abuts the sliding latch 2.

In the present embodiments, the card slot structure 14 is located on the sliding direction of the sliding latch 2, and the component force that is acted on the sliding latch 2 from the elastic member 5 is smaller, so that the sliding resistance of the sliding latch 2 is smaller. In some embodiments, the card slot structure 14 includes two opposite card boards 141 and a bottom board 142 that is communicated with the two card boards 141 and is close to one end of the sliding surface 21. A tail board 25 is provided on one end of the sliding latch 2 that is far away from the door hook 4 and is opposite to the baffle plate 23. The elastic member 5, the tail board 25 and the baffle plate 23 are located between the two card boards 141. The tail board 25 abuts the elastic member 5 and is slidably matched with the bottom board 142.

Furthermore, a rotation axis of the tactile disk member 3 and the rotating surface 321 are provided adjacent to the chute structure 13. In the present embodiments, a distance between the sliding latch 2 and the tactile disk member 3 may be reduced, so that the interlock switch structure is more compact. In some embodiments, the rotating surface 321 is provided far away from the rotation axis of the tactile disk member 3, so that the sliding latch 2 only takes a small force to drive the tactile disk member 3 to rotate.

Furthermore, the tactile disk member 3 includes a plate shaped disk body 31 and a flange 32 that is vertically disposed at the edge of the disk body 31. The rotating surface 321 and the contact surfaces 322 are formed on the flange 32. The rotating axis of the tactile disk member 3 is perpendicular to the substrate 11, and the disk body 31 is in parallel to the substrate 11.

In the present embodiments, it should be understood that if the tactile disk member 3 is simply taken advantage of the thin-walled structure, the area of the contact surfaces 322 that may be formed on the circumferential surface of the tactile disk member 3 is relatively small; when the axial mounting dimension of the tactile disk member 3 fluctuates greatly, it probably cannot guarantee the contact between the contact surfaces 322 and the corresponding contact points 60 of the micro-switches. The width of the contact surfaces 322 in the axial direction maybe increased by providing the flange 32, thus improving the matching stability between the contact surfaces 322 and the contact points 60.

Furthermore, the circumferential surface of the tactile disk member 3 has the inclined surfaces 323 to communicate with the contact surfaces 322. When the tactile disk member 3 is rotated in the forward direction, the contact points abut the inclined surfaces 323 at first and then abut the contact surfaces 322.

In the present embodiments, it should be understood that although the ends of the contact points 60 are generally provided with round corners, if the angle between the slot wall surface of the evading slot that is adjacent to the contact surfaces 322 and the corresponding contact surface 322 is too small, may cause the contact points 60 to jam. Therefore, by providing the inclined surfaces 323 on the circumferential surface of the tactile disk member 3 to communicate with the contact surfaces 322, ensuring that the contact points 60 smoothly slide to match with the corresponding contact surfaces 322. The inclined surfaces 323 mainly play the guiding role. Therefore, the inclined surfaces 323 may be any one of the planar shape, the concave arc surface and the convex arc surface.

Furthermore, the micro-switches include a primary switch 61, a secondary switch 62 and a supervisory switch 63. In the process of locking the door hook, the tactile disk member 3 sequentially abuts the contact points 60 of the supervisory switch 63, the secondary switch 62 and the primary switch 61; in the process of releasing the door hook, the tactile disk member 3 sequentially leaves the contact points 60 of the primary switch 61, the secondary switch 62 and the supervisory switch 63.

In the present embodiments, the primary switch 61 is used for controlling a main circuit of the microwave oven, the secondary switch 62 is used for controlling a detecting circuit of opening and closing the door of the microwave oven, and the supervisory switch 63 is used to control the switch circuit of the primary switch 61 and the secondary switch 62.

Specifically, an axis angle is formed by the rotation of the contact surface 322 relative to the tactile disk member 3, and a size relationship is that the contact surface 322 corresponding the supervisory switch 63 is greater than the contact surface 322 corresponding the secondary switch 62. For example, when the distance between the contact surface 322 and the axis of the tactile disk member 3 is equal, and a length relationship of the contact surface 322 along a circumferential direction is that the contact surface 322 corresponding the supervisory switch 63 is greater than the contact surface 322 corresponding the secondary switch 62.

Figure 4:
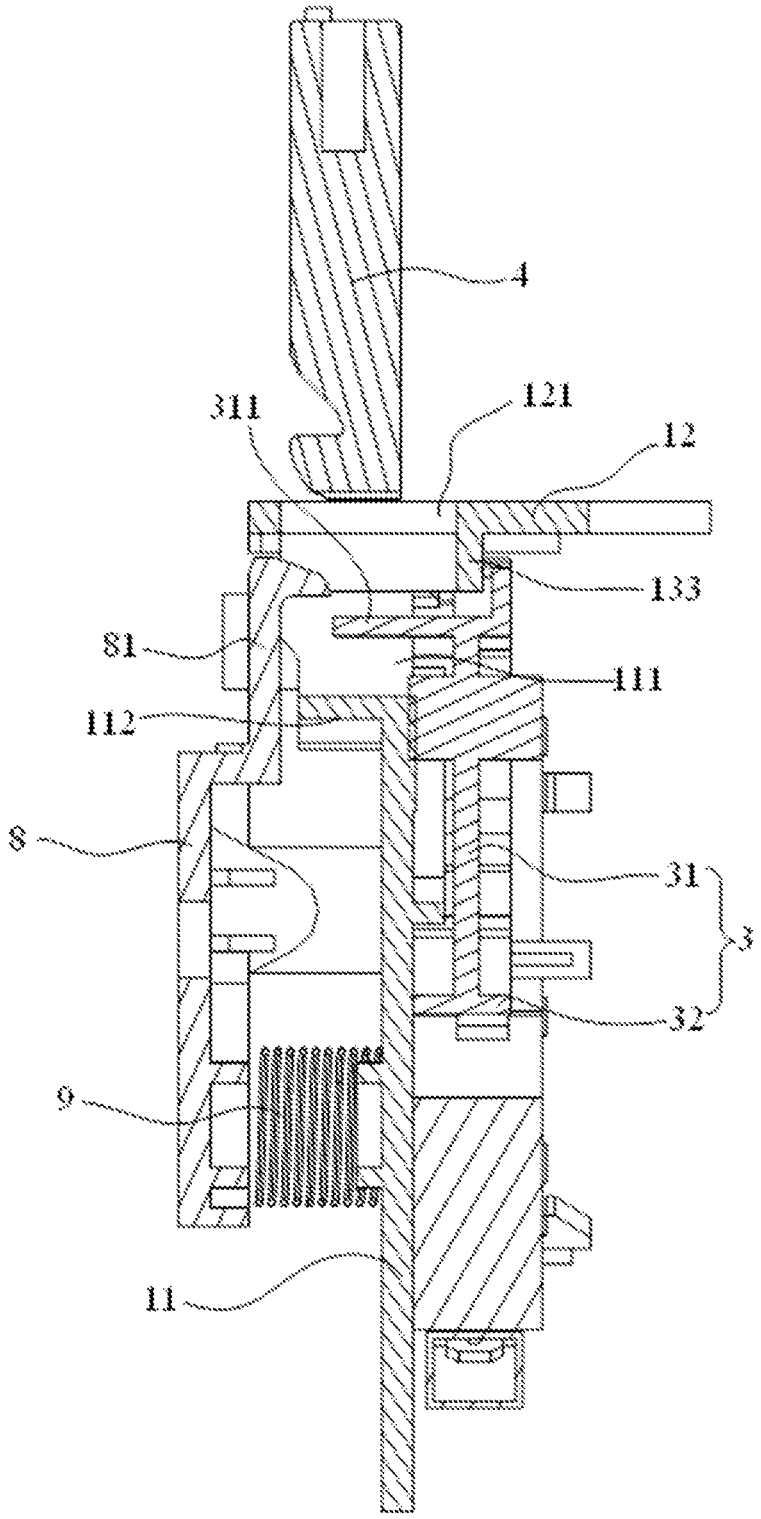
FIG. 4 is a sectional view along a line of IV-IV in FIG. 3.
Figure 5:
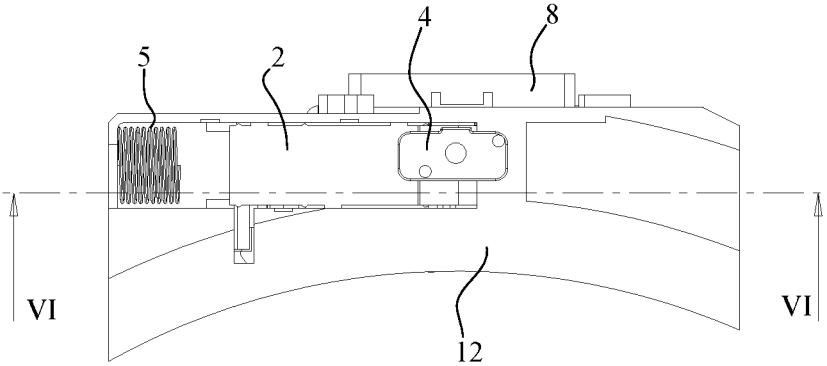
FIG. 5 is a top view of an interlock switch structure in FIG. 1.
Figure 6:
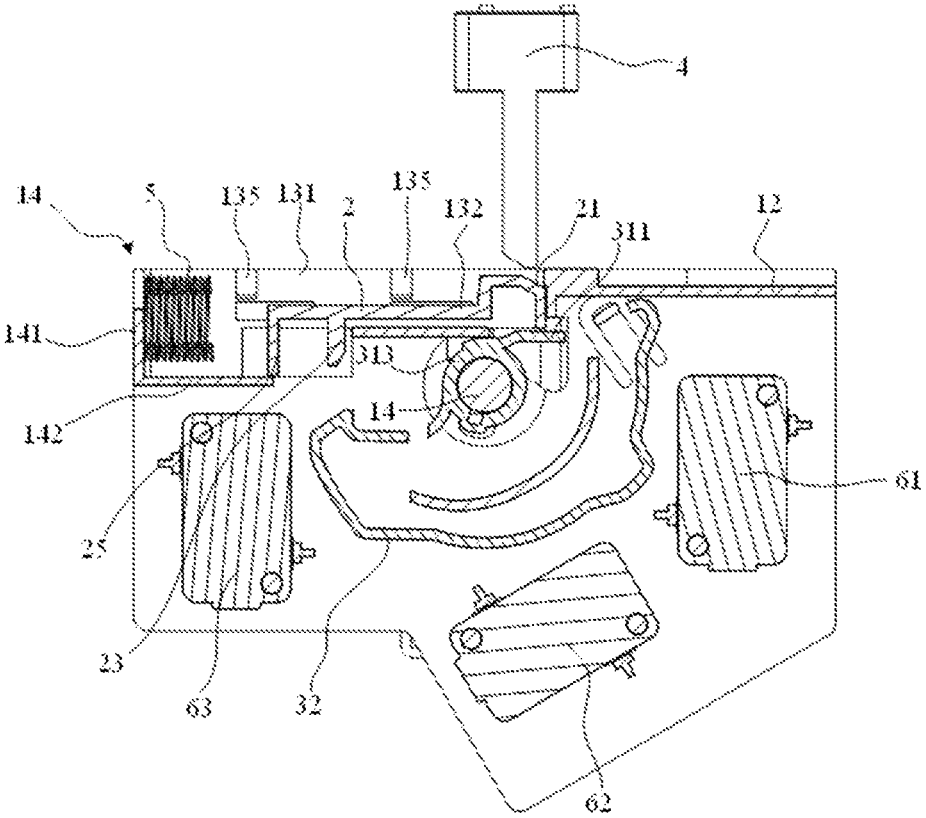
FIG. 6 is a sectional view along a line of VI-VI in FIG. 5.
Figure 7:
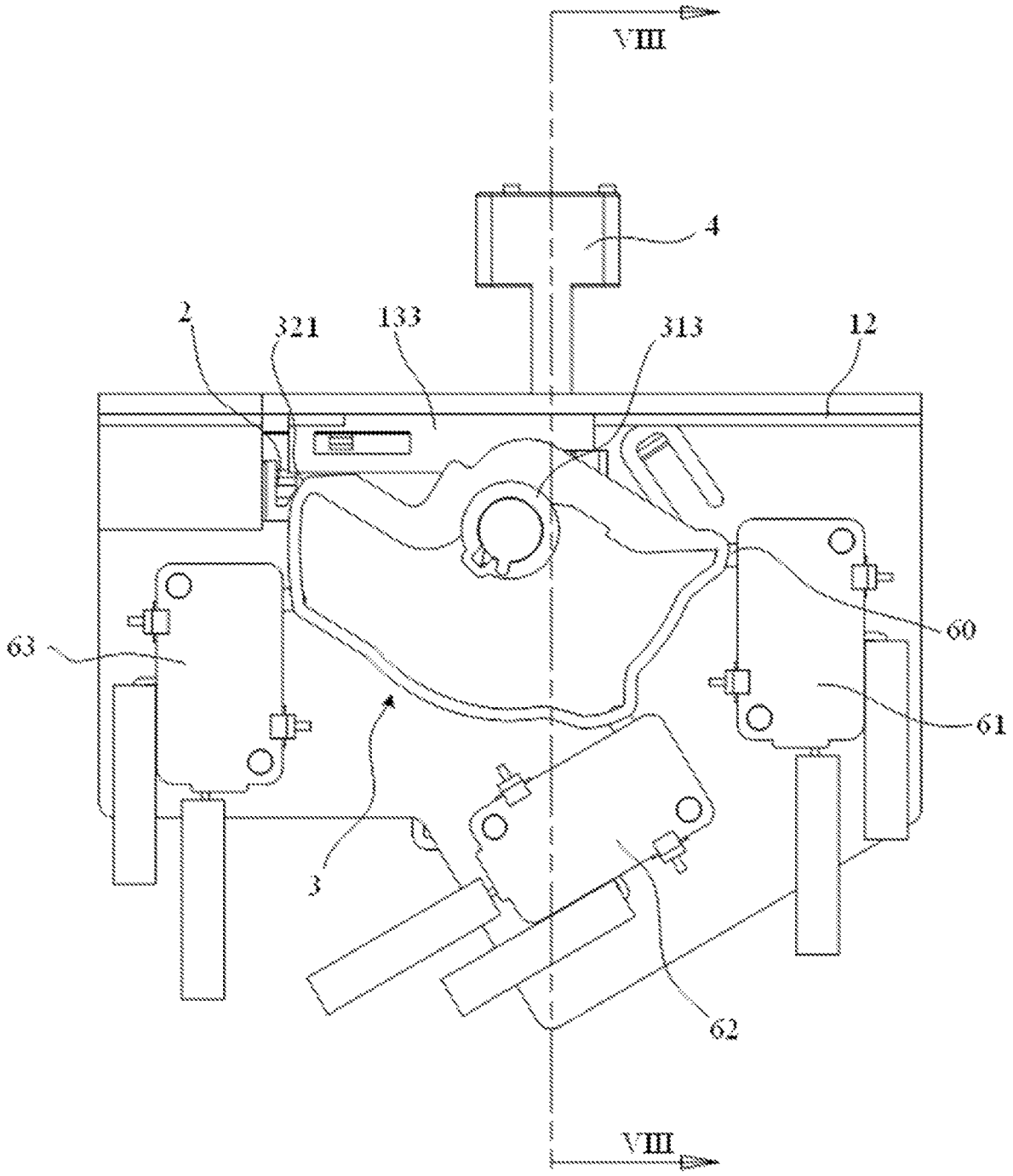
FIG. 7 illustrates a locked door hook of an interlock switch structure of the present disclosure.
Figure 8:
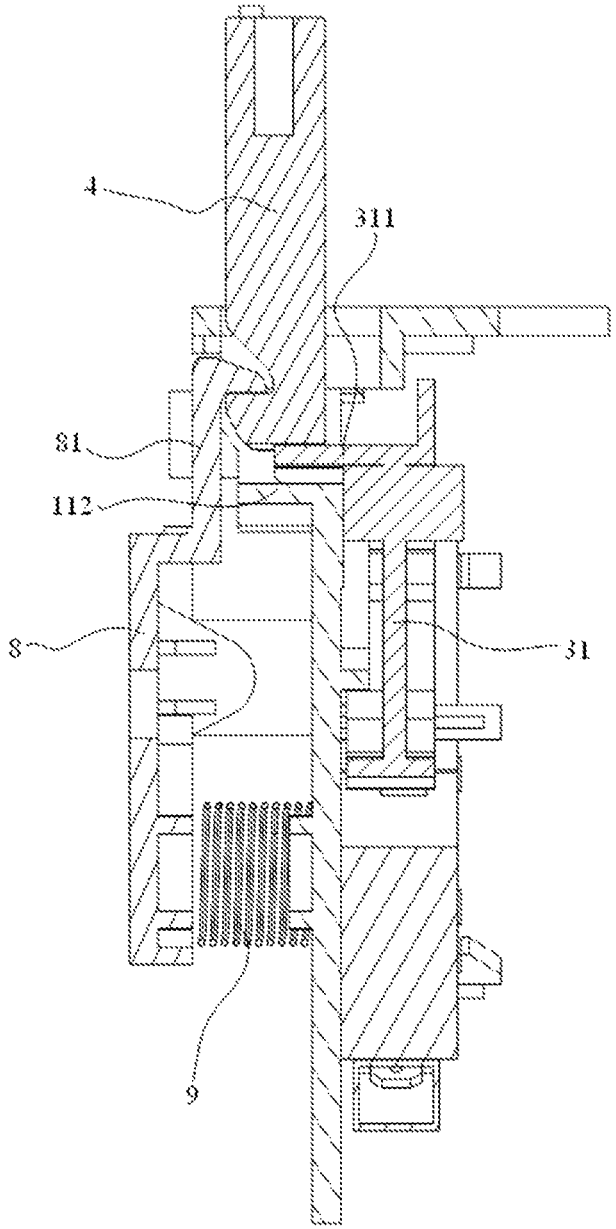
FIG. 8 is a sectional view along a line of VIII-VIII in FIG. 7.
Figure 9:
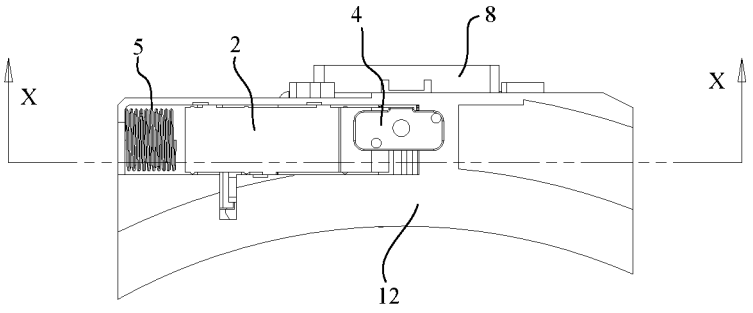
FIG. 9 is a top view of an interlock switch structure in FIG. 7.
Figure 10:
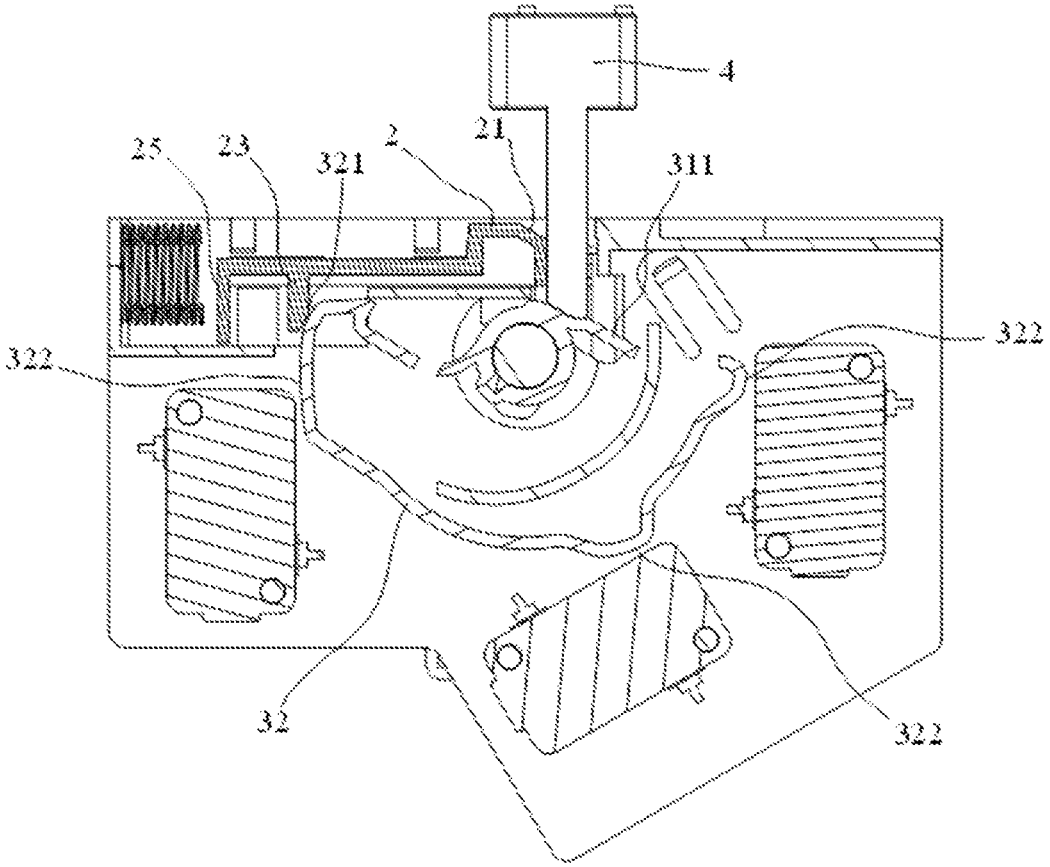
FIG. 10 is a sectional view along a line of X-X in FIG. 9.
Figure 11:
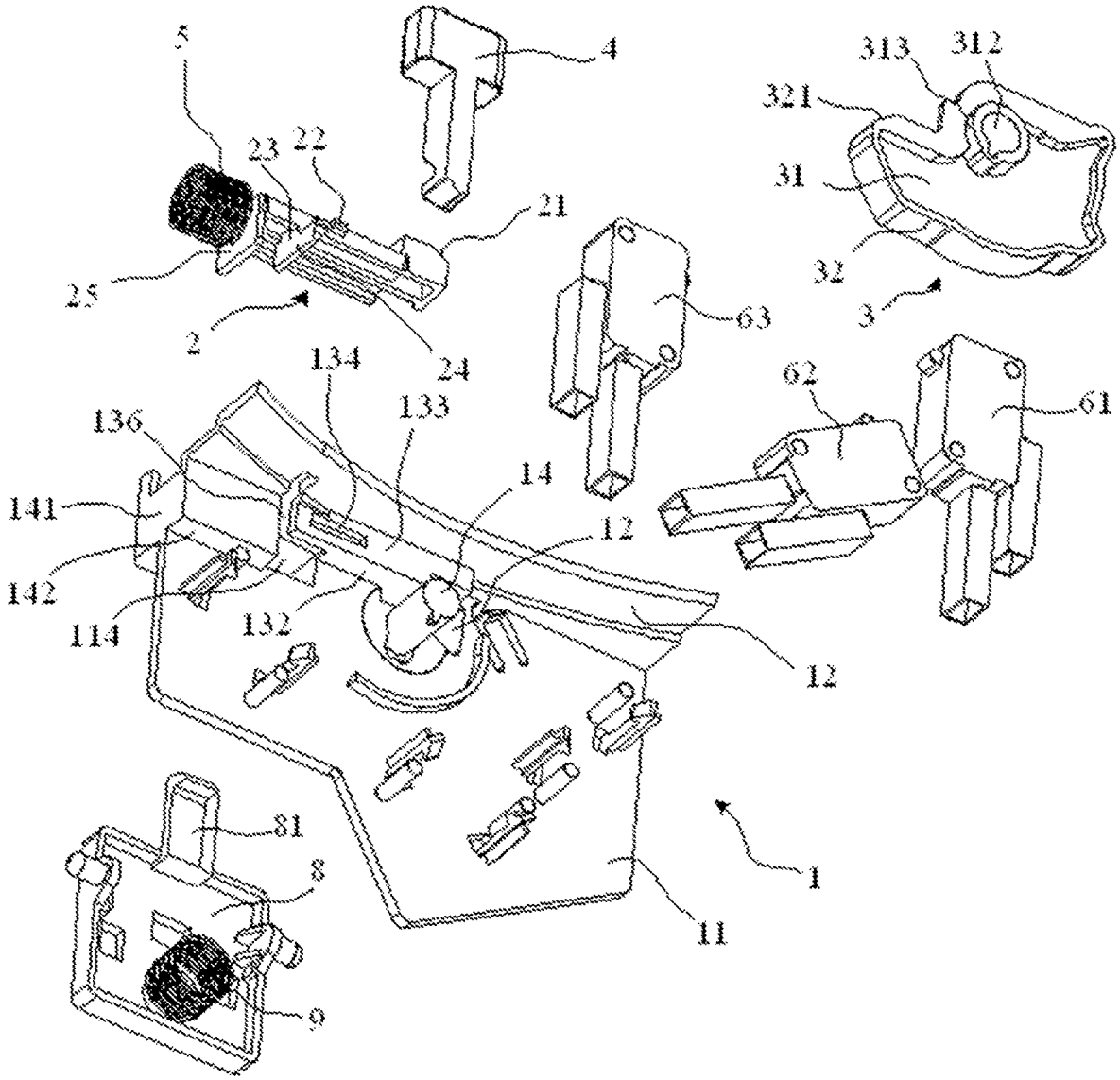
FIG. 11 is an exploded view of an interlock switch structure in FIG. 1.
Figure 12:
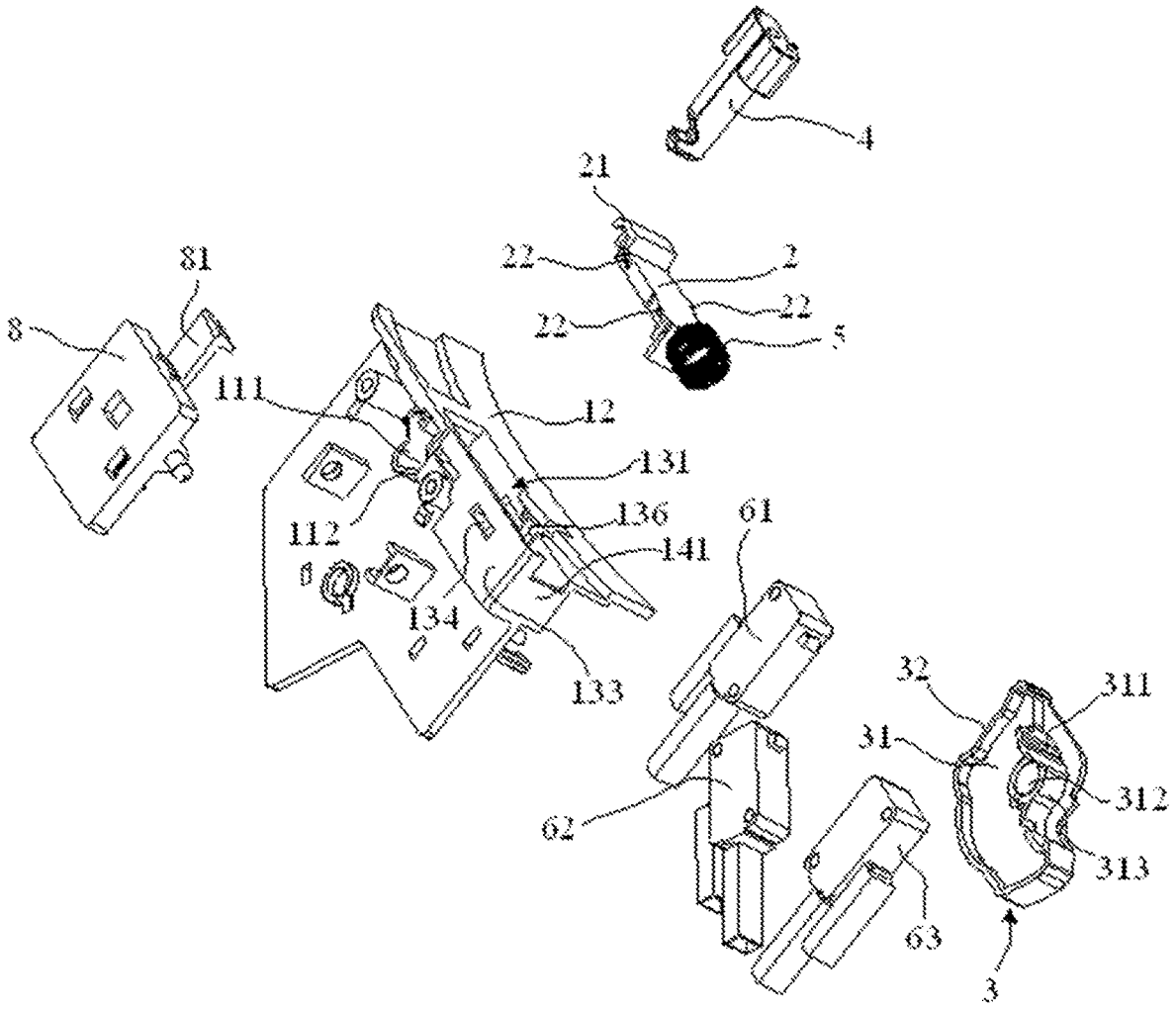
FIG. 12 is an exploded view of an interlock switch structure in FIG. 1 from another angle.

Furthermore, with reference to FIG. 4 and FIG. 8, in one present embodiment, the interlock switch structure further includes a pressure plate 8 and a second elastic member 9, the pressure plate 8 is provided on a side of the substrate 11 that is deviated from the tactile disk member 3, and a second elastic member 9 is provided between the pressure plate 8 and the substrate 11. The pressure plate 8 is pivotally communicated with the substrate 11, and the pressure plate 8 is provided with a hook 81 to match with the door hook 4.

In the present embodiments, in the process of locking the door hook, an end of the pressure plate 8 that is away from the door hook 4 is pressed at first and then the door hook 4 is pumped into the socket 121, releasing the pressure plate 8 when the door hook 4 is inserted into the right place; the pressure plate 8 is under an action of the second elastic member 9, the hook 81 is close to the door hook 4 and bucked with the door hook 4; in the process of releasing the door hook, the process is just the opposite.

The present disclosure also relates to the microwave oven, including the interlock switch structure, a concrete structure of the interlock switch structure is according to the specific embodiments. Since the microwave oven adopt all the technical solutions of a whole embodiments of the present disclosure, at least include all the beneficial effects that are brought by the technical solution of the embodiments, and here is no longer gives much more details.

In the present embodiments, the door hook 4 is used to match with the lock and to realize the interlock control. With the lock of the present disclosure, the microwave oven cannot only play the advantages of the stability control of the lock, but also make good use of the advantages of the compact structure of the lock. The whole body of the microwave oven can be a cube, a cuboid, a cylindrical or an elliptical cylinder shape. In some embodiments, the lock is located in a furnace of the microwave oven. The door hook 4 is arranged on the door, and the whole of the microwave oven is in cylindrical.

The foregoing descriptions are merely embodiments of the present disclosure, and are not intended to limit the scope of the present disclosure. An equivalent structural or equivalent process alternation made by using the content of the specification and drawings of the present disclosure, or an application of the content of the specification and drawings directly or indirectly to another related technical field, shall fall within the protection scope of the present disclosure.

What is claimed is:

1. An interlock switch structure, comprising:

a substrate;

a sliding latch;

a tactile disk member;

a door hook;

a first elastic member; and multiple micro-switches;

wherein, the substrate is provided with a chute structure; the sliding latch is slidably matched with a chute of the chute structure, the sliding latch is provided with a sliding surface to match with the door hook;

the tactile disk member is pivotally communicated with the substrate, the micro-switches are located on a periphery of the tactile disk member, and contact points of the micro-switches are toward the tactile disk member;

the tactile disk member is provided with a seesaw to match with the door hook, a circumferential surface of the tactile disk member is provided with a rotating surface to match with the sliding latch, and a plurality of contact surfaces that are matched with the contact points;

in a process of locking the door hook, the door hook sequentially abuts the sliding latch and the seesaw such that the sliding latch is displaced, and the tactile disk member is rotated in a forward direction, and each contact surface abuts a corresponding contact point, triggering a corresponding micro-switch; and in a process of releasing the door hook, the sliding latch is reset by the first elastic member and abuts the sliding surface such that the tactile disk member is rotated in reverse, and each contact surface leaves the corresponding contact point, resetting the corresponding micro-switch.

2. The interlock switch structure of claim 1, wherein the tactile disk member comprises a disk body and a flange that is vertically disposed at an edge of the disk body; the rotating surface and the contact surfaces are formed on the flange; a rotating axis of the tactile disk member is perpendicular to the substrate, and the disk body is in parallel to the substrate.

3. The interlock switch structure of claim 2, wherein the circumferential surface of the tactile disk member has inclined surfaces to communicate with the contact surfaces such that when the tactile disk member is rotated in a forward direction, the contact points abut the inclined surfaces at first and then abut the contact surfaces.

4. The interlock switch structure of claim 3, wherein a rotating shaft is convexly arranged on the substrate, a shaft hole is arranged on the disk body to match with the rotating shaft, the disk body is provided with a shaft sleeve that is located on an edge of the shaft hole, and the shaft sleeve is matched with the rotating shaft.

5. The interlock switch structure of claim 2, wherein the rotating shaft is convexly arranged on the substrate, the shaft hole is arranged on the disk body to match with the rotating shaft, the disk body is provided with the shaft sleeve that is located on the edge of the shaft hole, and the shaft sleeve is matched with the rotating shaft.

6. The interlock switch structure of claim 2, wherein the substrate is provided with a via hole at a position corresponding to the seesaw and the seesaw is passed through the via hole and rotated with the substrate in the via hole.

7. The interlock switch structure of claim 6, wherein a supporting board is convexly provided on a side of the tactile disk member and the side of the tactile disk member is deviated from the substrate; the supporting board is disposed at an edge of the via hole.

8. The interlock switch structure of claim 1, wherein a panel is vertically arranged on an edge of the substrate, a socket is provided on the panel and it matches with the door hook, the chute structure is integrally provided with the panel, and the chute structure is provided with an opening on the panel for loading the sliding latch.

9. The interlock switch structure of claim 1, wherein the micro-switches comprises a primary switch, a secondary switch and a supervisory switch; in the process of locking the door hook, the tactile disk member sequentially abuts the contact points of the supervisory switch, the secondary switch and the primary switch; and in the process of releasing the door hook, the tactile disk member sequentially leaves the contact points of the primary switch, the secondary switch and the supervisory switch.

10. The interlock switch structure of claim 1, wherein, the interlock switch structure further comprises a pressure plate and a second elastic member, the pressure plate is provided on a side of the substrate that is deviated from the tactile disk member, the second elastic member is provided between the pressure plate and the substrate; the pressure plate is pivotally communicated with the substrate, and the pressure plate is provided with a hook to match with the door hook.

11. A microwave oven comprises an interlock switch structure, wherein the interlock switch structure further comprises:

a substrate;

a sliding latch;

a tactile disk member;

a door hook;

a first elastic member; and multiple micro-switches;

wherein, the substrate is provided with a chute structure, the sliding latch is slidably matched with a chute of the chute structure, the sliding latch is provided with a sliding surface to match with the door hook;

the tactile disk member is pivotally communicated with the substrate, the micro-switches are located on a periphery of the tactile disk member, and contact points of the micro-switches are toward the tactile disk member;

the tactile disk member is provided with a seesaw to match with the door hook; a circumferential surface of the tactile disk member is provided with a rotating surface to match with the sliding latch, and a plurality of contact surfaces that are matched with the contact points;

in a process of locking the door hook, the door hook sequentially abuts the sliding latch and the seesaw such that the sliding latch is displaced, and the tactile disk member is rotated in a forward direction, and each contact surface abuts a corresponding contact point, triggering a corresponding micro-switch; and in a process of releasing the door hook, the sliding latch is reset by the first elastic member and abuts the sliding surface such that the tactile disk member is rotated in reverse, and each contact surface leaves the corresponding contact point, resetting the corresponding micro-switch.

12. The microwave oven of claim 11, wherein the tactile disk member comprises a disk body and a flange that is vertically disposed at an edge of the disk body; the rotating surface and the contact surfaces are formed on the flange; an rotating axis of the tactile disk member is perpendicular to the substrate, and the disk body is in parallel to the substrate.

13. The microwave oven of claim 12, wherein the door hook is provided on a door of the microwave oven, and the substrate is provided on a furnace of the microwave oven.

14. The microwave oven of claim 12, wherein the microwave oven is in a cylindrical shape.

15. The microwave oven of claim 11, wherein a panel is vertically arranged on the edge of the substrate, a socket is provided on the panel and it is matched with the door hook, the chute structure is integrally provided with the panel, and the chute structure is provided with an opening on the panel for loading the sliding latch.

16. The microwave oven of claim 11, wherein the micro-switches comprises a primary switch, a secondary switch and a supervisory switch; in the process of locking the door hook, the tactile disk member sequentially abuts the contact points of the supervisory switch, the secondary switch and the primary switch; and in the process of releasing the door hook, the tactile disk member sequentially leaves the contact points of the primary switch, the secondary switch and the supervisory switch.

* * * * *